United States Patent [19]

Champagne

[11] Patent Number: 4,707,874

[45] Date of Patent: Nov. 24, 1987

[54] METHOD OF WATERPROOFING AN ARTICLE OF FOOTWEAR AND THE WATERPROOFED ARTICLE PRODUCED THEREFROM

[75] Inventor: Michel R. Champagne, Ile Bizard, Canada

[73] Assignee: Genfoot, Inc., Quebec, Canada

[21] Appl. No.: 839,064

[22] Filed: Mar. 13, 1986

[51] Int. Cl.[4] ..... A43B 7/12; A43B 1/10

[52] U.S. Cl. ..... 12/142 E; 12/142 K; 36/7.3; 36/4

[58] Field of Search ..... 12/142 K, 142 E, 142 EV; 36/4, 9 R, 98, 7.3, 8.1; 264/DIG. 8; 2/169, 164

[56] References Cited

U.S. PATENT DOCUMENTS

| | | | |
|---|---|---|---|
| 2,200,333 | 5/1940 | Herzog et al. | 36/4 |
| 2,306,306 | 12/1942 | Ferrettie | 36/4 |
| 2,533,453 | 12/1950 | Gottschalk | 36/4 |
| 2,880,467 | 4/1959 | Wibbens | 12/142 E |
| 2,974,373 | 3/1961 | Streed et al. | 36/7.3 |
| 3,035,309 | 5/1962 | Bingham, Jr. | 36/7.3 |
| 3,228,819 | 1/1966 | Bingham, Jr. | 12/142 EV |
| 3,440,714 | 4/1969 | Ryan et al. | 36/7.3 |
| 3,570,149 | 3/1971 | Kogert et al. | 36/98 |
| 4,188,680 | 2/1980 | Adams | 36/4 |
| 4,287,629 | 9/1981 | Stalteri | 36/98 |

FOREIGN PATENT DOCUMENTS

| | | | |
|---|---|---|---|
| 1685766 | 11/1970 | Fed. Rep. of Germany | 36/4 |
| 1054095 | 2/1954 | France | 36/4 |

*Primary Examiner*—Henry S. Jaudon
*Assistant Examiner*—Steven N. Meyers
*Attorney, Agent, or Firm*—Scully, Scott, Murphy & Presser

[57] ABSTRACT

The invention relates to a method of waterproofing an article of footwear, for example, a boot, and the article of footwear produced therefrom. To waterproof the article a solution of effective amounts of a polymeric material and solvent is applied to inner surface areas of the article sought to be waterproofed. The solution is then substantially dried to produce a layer of a waterproof polymeric material over the surface of selected areas of the inside of the article. Conveniently and efficiently the layer of solution may be applied to the inner surface of the article by transferring a quantity of the solution into the article until the article is filled to the desired level (e.g. upper ankle level) and therafter orienting the article appropriately to cause the solution to spread to all inner surface areas of the foot portion of the article. Following this the excess solution is removed from the article by tilting the article causing the excess solution to drain out of the article. The remaining inner surface coating of the solution is then allowed to substantially dry so as to result in a layer of waterproof material covering the inner surface of the bottom part of the article.

7 Claims, 2 Drawing Figures

METHOD OF WATERPROOFING AN ARTICLE OF FOOTWEAR AND THE WATERPROOFED ARTICLE PRODUCED THEREFROM

FIELD OF THE INVENTION

The invention pertains to the manufacturing of footwear and in particular to a method of waterproofing an article of footwear and the article produced therefrom.

BACKGROUND OF THE INVENTION

There is a consumer demand for waterproof footwear and in particular for waterproof boots designed for wear in winter snow conditions and/or for hiking over wet ground. However, the more comfortable materials used for making footwear are generally natural materials, for example leather which is pliable and readily molds to the shape and configuration of the wearer's foot, ankle and leg area within the boot. This advantage though is for some purposes outweighed by the disadvantage of one characteristic of leather, namely the fact that it is not waterproof. Furthermore, silicon treatments and the like are in practice not effective to thoroughly waterproof a leather boot as water tends to eventually penetrate the seam lines etc. notwithstanding any such treatment. Consequently there is a need for an effective and convenient method of waterproofing outdoor footwear.

Of course, there are available on the market rubber boots which are waterproof i.e. those which are formed of rubber from a single molding without any seam or attachment lines of any sort. However, full length rubber boots are not very comfortable for walking as the rubber tends to resist bending around the ankle area during the walking motion and is not suitable for close fitting lace-up boot designs etc.. Thus, boots have been developed having a lower rubber portion (or other waterproof material) and an upper portion attached thereto at about the ankle area of the boot, the upper portion commonly being comprised of leather and/or other non-waterproof material. Usually the two portions are stitched together along the line where the two portions meet (i.e. at the attachment or seam line). For some purposes this type of boot is sufficiently waterproof. However, since water may still penetrate the stitch holes at the attachment line and other seams, this form of boot is only waterproof when used in surface snow or water conditions in which the snow or water does not reach a level slightly below the attachment line. Thus there is a need for a method of waterproofing a boot at the attachment line at which a non-waterproof upper portion is attached to a waterproof bottom portion and other seams and joins of the boot.

SUMMARY OF THE INVENTION

The invention claimed herein is a method of waterproofing an article of footwear and an article of footwear waterproofed thereby.

The waterproofing method includes the steps of: (i) covering inner surface areas of the article with a layer of solution; comprising effective amounts of a polymeric material and solvent and, (ii) substantially drying the layer of solution. The step of covering inner surface areas of the article with a layer of solution may include transferring a suitable quantity of the solution into the article and thereafter orienting the article appropriately to cause the solution to spread and cover the inner surface areas of the article with a layer of solution. The inner surface areas of the article may be prepared for receiving the solution for example by first applying a suitable solvent to the surface of the material to be waterproofed to remove certain surface materials which might be present there tending to inhibit the bonding of the solution to the surface.

A waterproofed article of footwear is also provided in accordance with the invention, the article of footwear having on one or more inner surface areas thereof, a layer of a substantially dried solution comprising effective amounts of a polymeric material and solvent.

DESCRIPTION OF A PREFERRED EMBODIMENT

Figure 1:
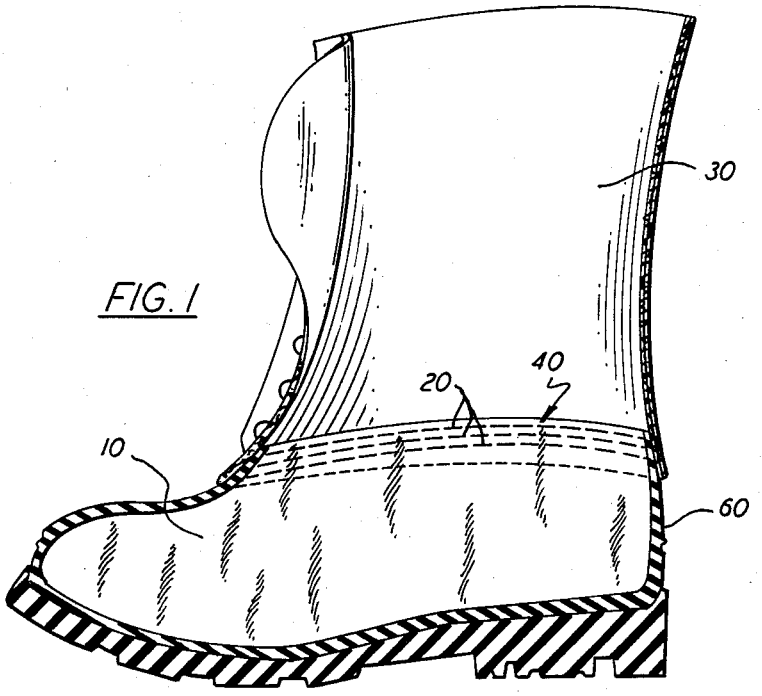
FIG. 1 illustrates the inside portion of a boot which has been prepared for receiving the waterproofing solution of the invention, the boot having been cut in half longitudinally for the purpose of illustration.
Figure 2:
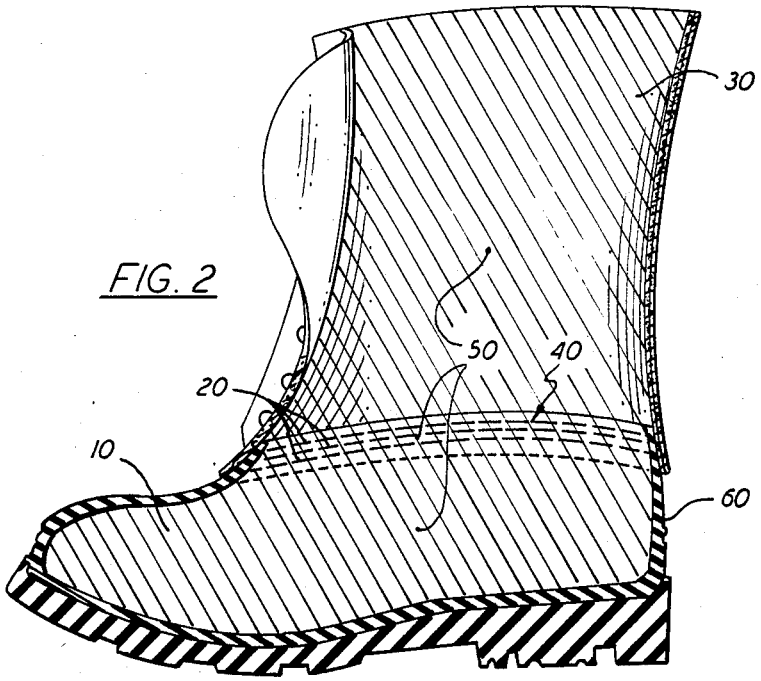
FIG. 2 illustrates the inside portion of a boot which has been waterproofed in accordance with the invention, the boot having been cut in half longitudinally for the purpose of illustration.

The present invention provides a waterproofing method which is particularly effective when used with boots comprising a waterproof bottom part (i.e. the foot portion of the boot) which is attached to an upper part along an attachment line located at about the height of the ankle portion of the boot. According to this type of boot (as illustrated in FIGS. 1 and 2), the upper part 30 and bottom part 60 are stitched together using multiple rows of stitching to form a stitchband 20, the upper part comprising leather (and/or other material as desired) and the bottom part comprising a waterproof material, for example a thermoplastic rubber material. To enhance the outer appearance of the boot the leather upper part 30 is preferably fitted over the top of the bottom part 40 such that the stitching lines appear over the leather on the outside of the boot.

Before attaching together the upper and bottom parts of the boot it may be preferable to prepare the inner surfaces of the bottom part for receiving the waterproofing solution depending upon the condition of the inner surface of the material and the type of material of which it is comprised. For example, if the bottom part is comprised of a thermoplastic rubber material, the surface may preferably be treated to remove certain surface materials which may be present there, such as oil etc., tending to inhibit the bonding of the polymeric material of the waterproofing solution to the surface of the material. A suitable method of preparing the surface is to brush or swab the surface areas requiring preparation with an aromatic solvent capable of penetrating the surface of the material. For example, the inventor has found that toluene works well.

However, other means may be used to suitably prepare the inner surface areas of the bottom part of the boot, for example, by attaching a thin layer of fabric to the inner surface during the fabrication phase of the lower part of the boot. The non-smooth surface of the fabric provides an appropriate surface for bonding to the polymeric material of the waterproofing solution. As shown in FIG. 1, in the preferred embodiment of the invention a layer of fabric 10 is used on the inner surface of the rubber (i.e. bottom) part 60 of the boot. However, the above-discussed solvent preparation method is used on the outer surface of the rubber part 40 at the stitching lines 20. That is, the solvent preparation method is used only on the outer portion of the rubber part 40 in the area of the stitchband 20, the solvent being applied to this area before the upper part 30 is attached to the bottom part 40.

Once the inner surface of the boot has been suitably prepared for receiving the waterproofing solution, the waterproofing solution is applied to at least the inner surface areas of non-waterproof portions of the boot which are sought to be rendered waterproof. If only some portions of the boot are comprised of a non-waterproof material it might be elected to apply the waterproofing solution to the inner surface of the material of only those portions of the boot. However, care should be taken to identify all seams and any other joining areas within the boot; the inner surface of all such areas should be covered with the waterproofing solution (as described below) to ensure that water does not penetrate through any joint or stitch holes. In the case of a boot of the type illustrated in FIGS. 1 and 2, comprising a bottom rubber part 60 and an upper part of leather (or other material) 30 stitched thereto at about the ankle, at least the stitch area of the boot must be covered with the waterproofing solution in order to render the boot waterproof to the level of the stitchband 20.

The waterproofing solution comprises a blend of effective amounts of a polymeric material and a solvent. The particular solution selected by the inventor consists of a blend of 30 parts of a solid thermoplastic rubber composition (in dry form) sold under the trade mark KRATON by Shell Chemical (U.S.A.) and 70 parts of the above-mentioned aromatic solvent toluene. This ratio of 30 parts thermoplastic solid to 70 parts solvent has been found by the inventor to provide desirable results for the purposes described herein as well as being economical. When dried the solution provides a rubber-like waterproof material.

There are many other appropriate constituents which might be selected instead of the above combination of KRATON and toluene and an appropriate choice can be readily made by anyone skilled in the chemical arts and familiar with polymeric materials. Furthermore, the above-suggested proportion of 30 parts thermoplastic solid to 70 parts solvent is not required to effect the successful implementation of the invention. In fact this proportion may be satisfactorily substantially varied from the suggested ratio of 30/70 depending upon the desired properties of the solution, for example, the thickness of the solution and the amount of time required to dry the solution.

The blend of polymer and solvent comprising the waterproofing solution is produced by adding the thermoplastic rubber composition to the toluene (solvent), for example in the proportion 30 parts to 70 parts, respectively, and then allowing the mixture to set for about 24 hours to permit complete saturation of the polymer by the solvent. Following this first 24 hour period, the mixture is aggitated, preferably for about one hour, and then allowed to set for a second 24 hour period. After this second 24 hour period, the solution may be used to waterproof a boot in accordance with the method of waterproofing described herein.

Although the waterproofing solution (of polymer and solvent) could be applied to the desired inner surface areas of the boot using a brush or similar tool, or by spraying, a more simple method of coating the inner surface has been developed by the inventor. Instead of directly applying the solution to the surfaces of non-waterproof portions of the boot, the inventor simply pours the waterproofing solution into the boot until the boot is filled with the solution to an appropriate level (for example to the level of the lowest design opening in the boot), thereby covering the whole inner surface area at once. The boot is then oriented appropriately (for example by tilting the boot) to cause the solution to spread thoroughly over the inner surface of the boot and to release any air pockets which might have formed between the solution and the inner surface of the boot during the step of filling the boot with the solution. Once this has been done, the boot is set aside for about 3 to 5 minutes to allow the solution to penetrate and seal any apertures in the boot such as stitch holes. A longer time period might be required depending upon the type of material being waterproofed and the consistency of the waterproofing solution. After this setting period, the boot is canted for about 15 minutes to drain the excess solution out of the boot. Then the boot is inverted and the layer of solution covering the inner surface of the boot is allowed to dry in a well ventilated area. Generally, a drying period of about 12 to 24 hours may be expected although the time required to substantially dry the solution will depend upon a number of factors, for example, the ambient temperature and the degree of ventilation in the area of the boot.

FIG. 2 of the drawings illustrates the inner surface of a boot which has been waterproofed in accordance with the above method. The shaded area 50 represents a layer of waterproofing solution covering the inner surface of the boot. If desired, a flock or lint-like surface on the layer of solution may be created by applying flocking particles to the surface of the layer of solution before it has fully dried. The particles will stick to the solution and be secured by the layer once it has dried.

The specific steps of the waterproofing method described above and the specific embodiment illustrated by the drawings are not intended to restrict the scope of the invention claimed herein by the inventor. To the contrary, the method and article of the invention are defined by the appended claims only. Reference should be made to the appended claims for a determination of the scope of the invention claimed by the inventor.

I claim:

1. A method of waterproofing a fabricated article of footwear comprising the steps of:

(a) coating selected inner surface areas of said article with a layer of polymeric solution comprising effective amounts of a polymeric material and solvent, said solution solidifying upon due exposure to ambient air, said selected areas being those sought to be waterproof, said coating step including the step of coating said inner surface from inside the article; and (b) substantially air drying said layer of solution at ambient temperature.

2. A method according to claim 1 whereby said step of coating inner surface areas of said article includes the steps of transferring into said article a suitable quantity of said solution, orienting said article appropriately to cause said solution to spread and coat said inner surface areas of said article and removing the excess of said solution from said article leaving a layer of solution coating said inner surface areas.

3. A method according to claim 2 whereby said method is applied to an article of footwear having an upper part and a substantially waterproof bottom part attached thereto, said quantity of solution transferred into said article being sufficient to fill said article to a level which is above the level of the attachment line at which said upper and bottom parts attach together.

4. A method according to claim 3 whereby said amounts of a polymeric material and solvent are in the proportion 30 parts and 70 parts, respectively.

5. A method according to claim 4 including the step of applying flocking to at least a portion of said layer of solution on said inner surface areas before said solution has substantially dried.

6. A method of waterproofing an article of footwear comprising the steps of:

(a) preparing selected inner surface areas of said article for receiving a coating of polymeric solution by substantially eliminating from said surface areas surface materials occurring thereon tending to inhibit the bonding of said polymeric solution to said surface areas whereby a suitable solvent is applied to said surface areas such that said solvent penetrates said surface areas;

(b) coating said inner surface areas with a layer of polymeric solution comprising effective amount of a polymeric material and solvent, said solution solidifying upon due exposure to ambient air, said coating step including the step of coating said inner surfaces from inside the article; and (c) substantially air drying said layer of solution at ambient temperature.

7. A method according to claim 6 whereby said step of coating said inner surface areas includes transferring into said article a suitable quantity of said solution, orienting said article appropriately to cause said solution to spread and coat said inner surface areas of said article and removing the excess of said solution from said article so as to leave a layer of solution coating said inner surface areas.

* * * * *